US005934949A

United States Patent [19]

Richter

[11] Patent Number: 5,934,949

[45] Date of Patent: Aug. 10, 1999

[54] ELECTRICAL TERMINAL ASSEMBLY WITH SELF-RETAINING CLAMP PLATE AND METHOD OF USING SAME

[75] Inventor: David N. Richter, Mexico, Mo.

[73] Assignee: Square D Company, Palatine, Ill.

[21] Appl. No.: 09/050,330

[22] Filed: Mar. 30, 1998

[51] Int. Cl.[6] ..... H01R 4/44

[52] U.S. Cl. ..... 439/781

[58] Field of Search ..... 439/781, 782, 439/801

[56] References Cited

U.S. PATENT DOCUMENTS

| | | | |
|---|---|---|---|
| 3,683,318 | 8/1972 | Them | 439/781 |
| 3,993,397 | 11/1976 | Gustshall | 439/781 |
| 4,310,214 | 1/1982 | Carlson | 439/801 |
| 4,820,206 | 4/1989 | Jullien et al. | 439/781 |
| 5,752,860 | 5/1998 | Greaves | 439/781 |

FOREIGN PATENT DOCUMENTS

| | | | |
|---|---|---|---|
| 680305 | 2/1964 | Canada | 439/781 |

*Primary Examiner*—Steven L. Stephan
*Assistant Examiner*—J. F. Duverne
*Attorney, Agent, or Firm*—Kareem M. Irfan; Larry I Golden

[57] ABSTRACT

The present invention provides a terminal assembly 18 and method for connecting an electrical connector to an electrical distribution device. The device has a housing 12 with an interior surface defining an interior space 16. The terminal assembly 18 includes a clamp body 20 having a first surface 26 and a second surface 28. A portion of the first surface extends downward to define an interior wall 30 of a cylinder. The interior wall 30 extends perpendicularly to the first surface 26. A substantial portion of the interior wall 30 of the cylinder has threads 40. A fastener 24 has a head at one end of an elongated body and screw threads 60 near the opposite end. The screw threads 60 being adapted to engage the threads 40 on the interior wall of the cylinder of the clamp body 20. A clamp plate 22 has a plate body 50 which is partially defined by a top surface 52 and a bottom surface 54. The plate body 50 has a plate aperture 56 for accommodating the fastener 24 through the plate body. The bottom surface 54 is shaped to abut an electrical connector and releasably engage the electrical connector between the bottom surface 54 and the first surface of the clamp body 20. The terminal assembly 18 also includes a retainer 62 for the fastener 24 in connection with the clamp body 20 and clamp plate 22 even with the clamp plate and clamp body separated from each other to accommodate the insertion of the electrical connector therebetween. The retainer 62 is connected to and provides mechanical cooperation between the clamp plate 22 and the interior surface of the housing.

16 Claims, 7 Drawing Sheets

ELECTRICAL TERMINAL ASSEMBLY WITH SELF-RETAINING CLAMP PLATE AND METHOD OF USING SAME

FIELD OF THE INVENTION

The present invention relates to a terminal assembly having a self-retaining clamp plate which provides an improved mechanical and electrical connection for use as a terminal on an electrical distribution device, and more particularly, as a load terminal on a circuit breaker. The clamp plate and fastener are retained within the circuit breaker even if the terminal is in the open position for insertion of an electrical connector.

BACKGROUND OF THE INVENTION

Load centers and other electrical distribution devices are commonly used in residential, commercial, and industrial applications. Individual circuit interrupters are mounted within these devices to protect branch circuits against overload and fault conditions. Basically, circuit interrupters like circuit breakers and fusible switches comprise a pair of separable contacts, a spring-operated mechanism for effecting separation of the contacts, and a tripping mechanism or fuse which automatically releases the operating mechanism upon occurrence of an overload or fault condition. Electrical connection to the circuit breakers, as well as other electrical distribution devices, are usually provided by load and line terminals designed to accept copper or aluminum single or stranded wire.

A problem can arise in providing proper mechanical and electrical contact between the terminal and wire during both normal and shorting conditions of the circuit breaker. Most terminals are a combination of a threaded screw and clamp plate. The bottom most threads of the screw are usually upset to prevent the screw from disengaging from or backing out of the terminal during wire installation. Upsetting some of the threads on the screw to retain the screw with the terminal leaves only enough depth on the screw to engage one or two threads with the clamp plate in the "hold area" of the terminal. As increasing torque is applied to the screw to secure the wire against the clamp plate, the threads on the screw or in the clamp plate may be stripped. The torque stripout value of the screw and terminal is occasionally below the minimum value needed for adequate connection between the wire and terminal.

The need arises to provide a clamp plate assembly for the terminal of electrical devices which does not upset screw threads to retain the screw with the clamp plate during wire installation. Providing more threads or "holding area" on a clamp plate assembly can improve torque stripout value well in excess of the minimum value needed for adequate connection between the wire and terminal. Furthermore, the clamp plate assembly should be inexpensive to manufacture and easy to install.

SUMMARY OF THE INVENTION

The present invention provides a terminal assembly for connecting an electrical connector to an electrical distribution device. The device has a housing with an interior surface defining an interior space. The terminal assembly includes a clamp body having a first surface and a second surface. A portion of the first surface extends downward to define an interior wall of a cylinder. The interior wall extends perpendicularly to the first surface. A substantial portion of the interior wall of the cylinder has threads. A fastener has a head at one end of an elongated body and screw threads near the opposite end. The screw threads being adapted to engage the threads on the interior wall of the cylinder of the clamp body. A clamp plate has a plate body which is partially defined by a top surface and a bottom surface. The plate body has a plate aperture for accommodating the fastener through the plate body. The bottom surface is shaped to abut an electrical connector and releasably engage the electrical connector between the bottom surface and the first surface of the clamp body. The terminal assembly also includes means for retaining the fastener in connection with the clamp body and clamp plate even with the clamp plate and clamp body separated from each other to accommodate the insertion of the electrical connector therebetween. The retaining means is connected to and provides mechanical cooperation between the clamp plate and the interior surface of the housing.

The present invention also provides for an electrical distribution device having a terminal assembly for connecting an electrical connector to the device. The terminal assembly has a clamp plate for connecting to the electrical connector. The device includes a housing with an interior surface defining an interior space. A stop surface is defined by a portion of the interior surface extending perpendicularly outwardly from the remainder of the interior surface. The stop surface is configured to engage a portion of the clamp plate to stop movement of the clamp plate.

A housing adapter for a terminal assembly is also provided by the present invention. The terminal assembly connects an electrical connector to an electrical distribution device. The device has a housing with an interior surface defining an interior space. The terminal assembly has a fastener for drawing a clamp plate and a clamp body together for connection to an electrical connector therebetween. The adapter includes a base having a surface. A stop surface is connected to the base. The stop surface extends perpendicularly outwardly from the surface of the base. The stop surface is configured for engaging a portion of the clamp plate to stop movement of the clamp plate. The adapter also includes means for fixedly connecting the base to the interior surface of the housing and positioning the stop surface in the pathway of the clamp plate being drawn to the clamp body to retain the fastener, clamp plate and clamp body together. The connecting means is integrally formed with the base.

A clamp plate for a terminal assembly is provided by the present invention. The terminal assembly connects an electrical connector to an electrical distribution device. The device has a housing with an interior surface defining an interior space. The terminal assembly has a fastener for drawing a clamp body and the clamp plate together for connection to an electrical connector therebetween. The clamp plate includes a plate body which is partially defined by a top surface, a bottom surface and a periphery. The plate body has a plate aperture for accommodating the fastener through the plate body. The bottom surface is shaped to abut the electrical connector and releasably engage the electrical connector between the bottom surface and the clamp body. The clamp plate includes at least one projection integrally formed with the plate body. The projection extends outwardly from the periphery of the plate body. The projection is adapted to engage the stop surface when the clamp plate is sufficiently separated from the clamp body for insertion of an electrical connector therebetween.

The present invention provides a method of retaining the individual components of a terminal assembly for connecting an electrical connector to an electrical distribution device. The device has a housing with an interior surface defining an interior space. The terminal assembly has a fastener for drawing a clamp plate and a clamp body together for connection to an electrical connector therebetween. The steps of the method include: affixing the clamp body to the interior surface of the housing; rotatably connecting the fastener to the clamp plate; and prior to disengaging the fastener from the clamp body, stopping the travel of the clamp plate against a portion of the interior surface of the housing as the fastener is rotated to separate the clamp plate from the clamp body so that the fastener is retained in connection with the clamp body and clamp plate even with the clamp plate and clamp body separated from each other to accommodate the insertion of the electrical connector therebetween.

An object of the present invention is to provide a terminal assembly for electrical devices with a clamp plate which is retained in the terminal assembly even in the open position for insertion of an electrical connector therein.

Another object of the present invention is to provide a terminal assembly having a torque stripout value well in excess of the minimum value needed for adequate connection with an electrical connector and a substantial increase in clamping pressure compared to the prior art.

A further object of the present invention is to provide a terminal assembly with a self-retaining clamp plate which is inexpensive to manufacture and convenient to install in an electrical distribution device.

Other and further advantages, embodiments, variations and the like will be apparent to those skilled-in-the-art from the present specification taken with the accompanying drawings and appended claims.

BRIEF DESCRIPTION OF THE DRAWINGS

In the drawings, which comprise a portion of this disclosure.

DETAILED DESCRIPTION OF THE INVENTION

Figure 1:
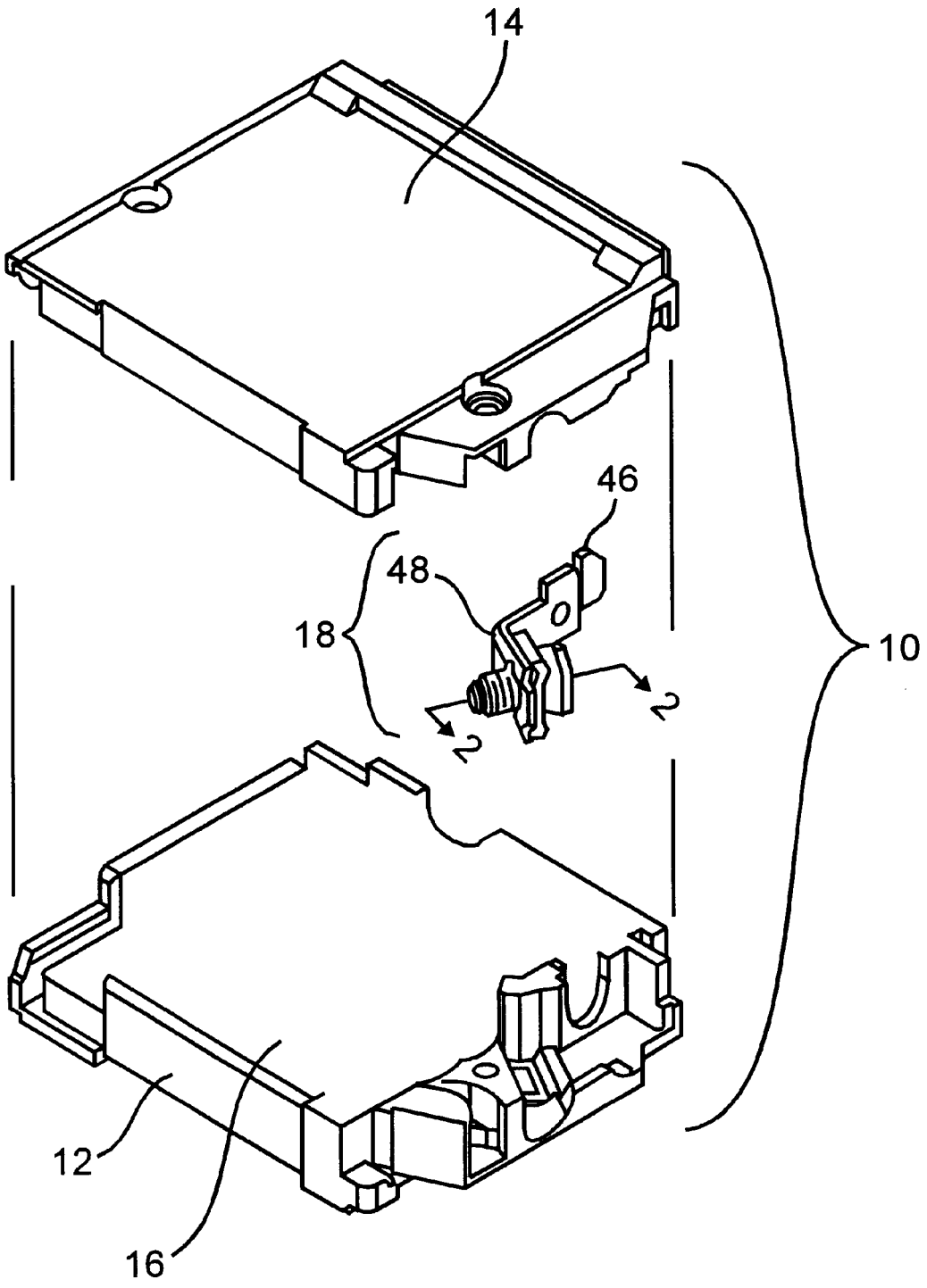
FIG. 1 is an exploded, perspective view of a circuit breaker enclosure with a terminal assembly having a high torque fastener of the present invention.

Referring now to FIG. 1, a circuit breaker 10 includes an electrically insulating housing 12 closed at one face by a detachable cover 14 which together enclose the components of the operating system (not shown) within an interior space 16. Mounted through the surface of the housing 12 is a preferred embodiment of the present invention depicted in the form of a terminal assembly 18. As illustrated, the terminal assembly 18 is used to make an electrical connection to a load to complete the circuit through the circuit breaker 10.

Figure 2:
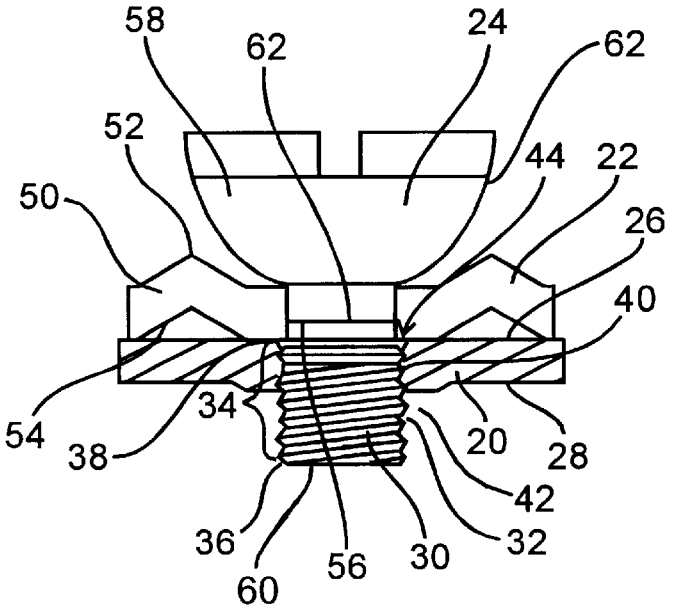
FIG. 2 is an isolated, cross sectional view of the terminal assembly in FIG. 1 with the integral high torque fastener, clamp plate and base of the present invention.

As illustrated in FIGS. 1 and 2, the terminal assembly 18 includes a clamp body 20 which is a female fastener component, a clamp plate 22, and a fastener 24 which is a male fastener component. The body 20 has a first surface 26 and a second surface 28. A portion of the first surface 26 is drawn downward to define an interior wall 30 of a cylinder 32. The interior wall 30 extends perpendicularly to the first surface 26. The interior wall is partially defined by a length 34 measured between one end 36 of the interior wall and a point 38 where the first surface 26 is drawn downwardly. The present invention is particularly advantageous when the length 34 of the interior wall 30 preferably extends beyond the second surface 28 and is significantly greater than the thickness of the body between the first and second surfaces 26, 28. Along a substantial portion of the interior wall 30 of the cylinder are threads 40 for engaging the fastener 24. The threads 40 along the length 34 provide a "hold area".

A portion of the second surface 28 also extends perpendicularly downward to define an exterior wall 42 of the cylinder. The thickness of the body 20 measured between the interior wall 30 and the exterior 42 is preferably less than the thickness of the body measured between the first surface 26 and the second surface 28. The cylinder 32 defines an aperture 44 through the first surface 26 and the second surface 28. The aperture 44 has a diameter of a predetermined size to accommodate the diameter of the fastener 24.

The body 20 also includes an elongated end 46 for making an electrical connection with the circuit within the interior space 16 of the circuit breaker. The elongated end 46 can make an electrical connection to a wire or other types of conventional electrical connectors. The mechanical connection can be of any type such as welding a wire to the elongated end 46 or using a press-fit, rivet, crimp, or other fastening arrangement. The elongated end 46 can extend along the same plane as the cylinder 32 as illustrated below or include a bend 48 out of the plane of the remainder of the body having the cylinder 32.

The clamp plate 22 includes a plate body 50 which is partially defined by a top surface 52 and a bottom surface 54. The plate body 50 includes a plate aperture 56 for accommodating the fastener 24 through the body. The top surface 52 is shaped to abut the fastener 24 in the proximity of the plate aperture 56. The bottom surface 54 is shaped to abut an electrical connector such as a wire (not shown) to releasably engage the electrical connector between the bottom surface 54 and the first surface 26 of the body.

The fastener 24 includes a head 58 for abutting the top surface 52 of the clamp plate. Torque can also be applied to the head 58 with a tool or by the hand of an operator. The fastener includes screw threads 60 opposite the head 58 which have a shape corresponding to the threads 40 along the length 34 of the interior wall of the cylinder. The screw threads 60 and threads 40 releasably engage each other.

The plate aperture 56 forms an annular ring 60 which has a diameter smaller than the head 58 of the fastener and the screw threads 60. The annular ring 62 retains the clamp plate 22 near the head 58 of the fastener while allowing the fastener 24 to rotate freely within the annular ring 62.

Figure 3:
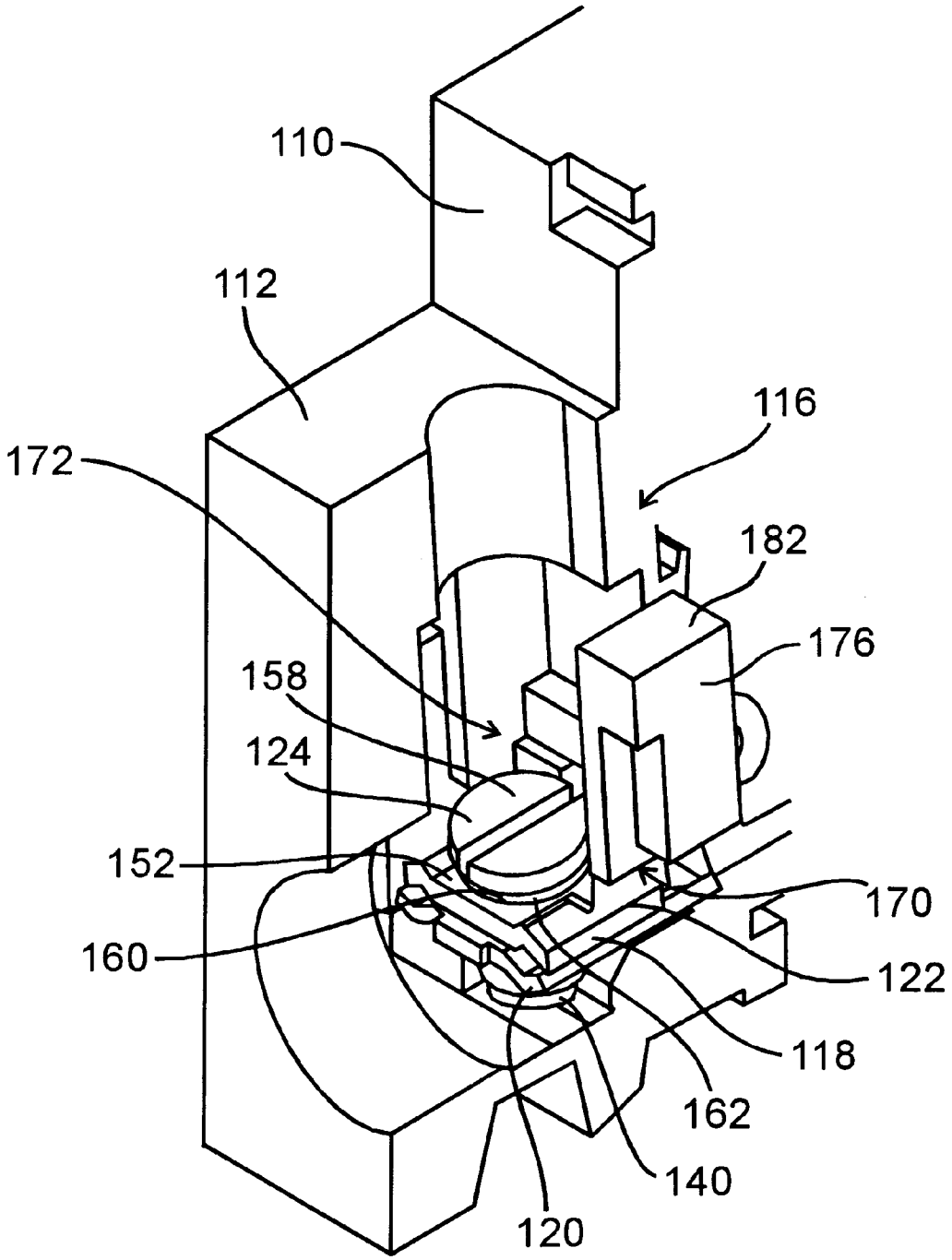
FIG. 3 is a partial perspective view of one preferred embodiment of an inventive terminal assembly within a circuit breaker housing with the clamp plate and a clamp body in a closed position.
Figure 4:
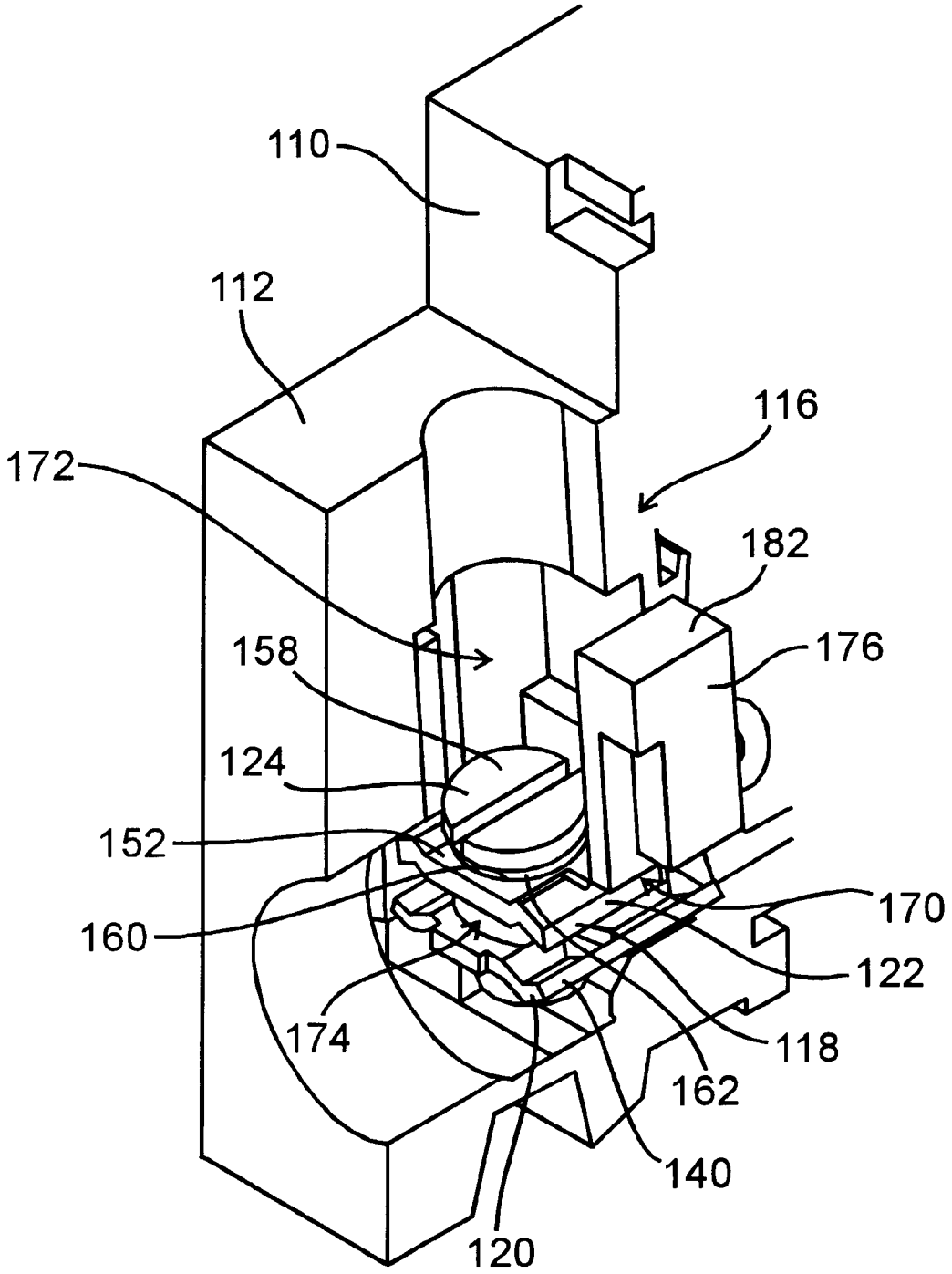
FIG. 4 is a partial perspective view of the inventive terminal assembly of FIG. 3 within a circuit breaker housing with the clamp plate and a clamp body in an open position.
Figure 5:
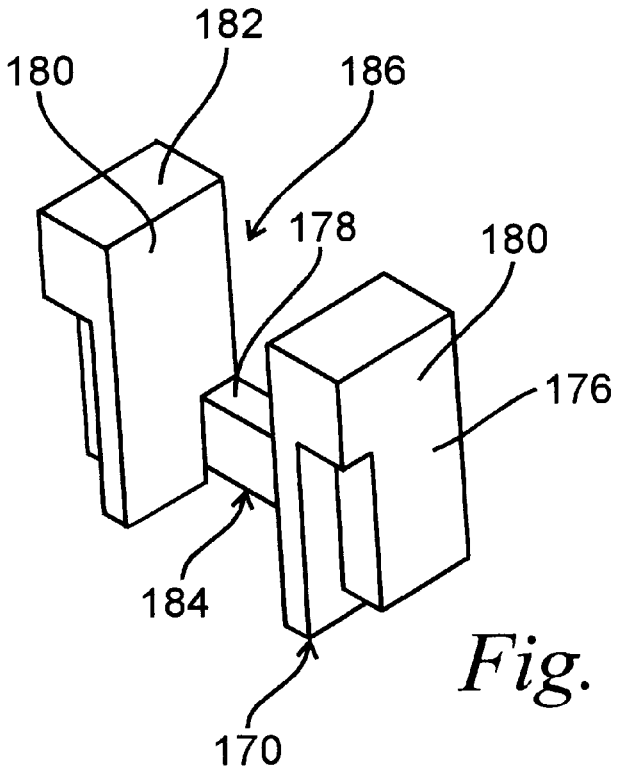
FIG. 5 is an isolated perspective view of the inventive housing adapter illustrated in FIGS. 3 and 4.
Figure 6:
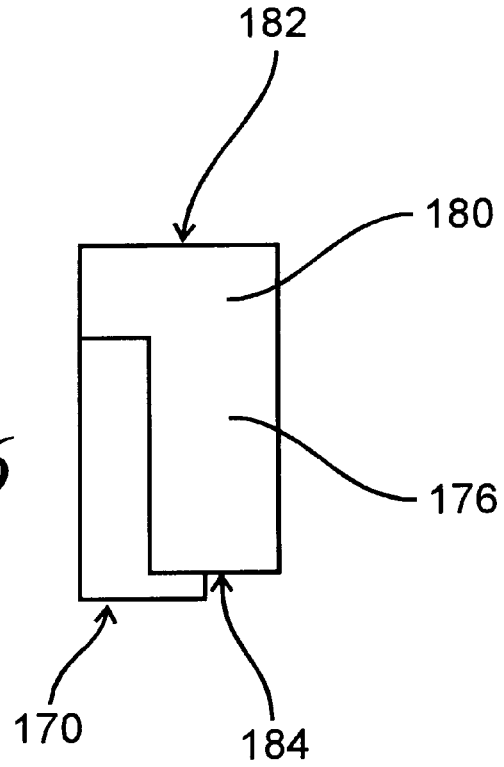
FIG. 6 is an isolated side view of the housing adapter illustrated in FIGS. 3 and 4.

As illustrated in FIGS. 3 and 4, one preferred embodiment of a terminal assembly 118 includes a stop surface 170 which is defined by a housing 112 within an interior space 116 and, more particularly within the terminal area 172. The stop surface 170 is positioned within the pathway traveled by a clamp plate 122 between an open position and a closed position respectively illustrated in FIGS. 3 and 4. The open position provides a space 174 between the clamp body 120 and the clamp plate 122 for insertion of a wire or other electrical connector therebetween. Preferably, the clamp body 120 is in a fixed position relative to the interior of the housing 112 by its connection to other components of the operating system (not shown) of a circuit breaker 110. The clamp plate 122 moves into the closed position by travelling toward the clamp body 120. As a fastener 124 is rotated in a clockwise direction, the engagement of the screw threads 160 of the fastener and the threads 140 of the clamp body draws an annular ring 162, and thus the clamp plate 122, to the clamp body 120. As a result, the wire or electrical connector is mechanically and electrically clamped therebetween.

As the fastener 124 is rotated in a counter-clockwise direction, the clamp plate 122 moves away from the clamp body 120 to return to the open position. Eventually, the travel of the clamp plate 122 away from the clamp body 120 is terminated by the stop surface 170. Some portion of a top surface 152 of the clamp plate 122 abuts and is stopped by the stop surface 170. Since the annular ring 162 connects the clamp plate 122 to the fastener 124, the fastener is stopped at this point along the pathway of travel and is retained in this position.

The stop surface 170 is preferably located along the travel pathway of the clamp plate a distance sufficient to allow enough space 174 between the clamp plate and clamp body for insertion of the wire and to prevent the bottom most screw threads 160 of the fastener from disengaging from the clamp body 120.

The housing 112 of the circuit breaker 110 can be configured to directly define the stop surface 170. In some instances, this may require retooling the molds for the housing 112 of the circuit breaker. To avoid the expense of this necessity and to advantageously allow retrofitting of existing circuit breakers, the present invention provides a housing adapter 176 which is configured to nest within or otherwise connect to the housing 112 defining the interior space 116 in the terminal area 172. The housing adapter 176 is partially defined by a base 178 with a pair of upstanding walls 180 integrally formed therewith. The upstanding walls 180 have a top surface 182 extending in an opposite direction away from the bottom surface 184 of the base 178. The base 178 and upstanding walls 180 define a channel 186 therebetween. The housing 112 connects to the housing adapter 176 by inserting into the channel 186 and abutting the top surface 182 of the upstanding walls and the bottom surface 184 of the base.

This method of mounting the housing adapter 176 to the housing 112 advantageously connects the two together without using a separate fastener. Other means of connecting the housing adapter 176 to the housing 112 are provided by the present invention. For example and not limitation, a fastener can be used to mate the housing adapter 176 and housing 112. A press-fit arrangement between the two pieces can be used.

The housing adapter 176 is also partially defined by the stop surface 170 which is aligned with a portion of the top surface 152 of the clamp plate to stop the travel of the clamp plate 122. With the connection between the clamp plate 122 and fastener 124 by means of the annular ring 162, bringing a portion of the top surface 152 into contact with the stop surface 170 also retains the fastener 124 in position and keeps the fastener 124 engaged with the remainder of the terminal assembly 118. The stop surface 170 extends perpendicularly outward from the bottom surface 184 of the base so that the base 178 does not otherwise interfere with the travel of the clamp plate 122.

Figure 9:
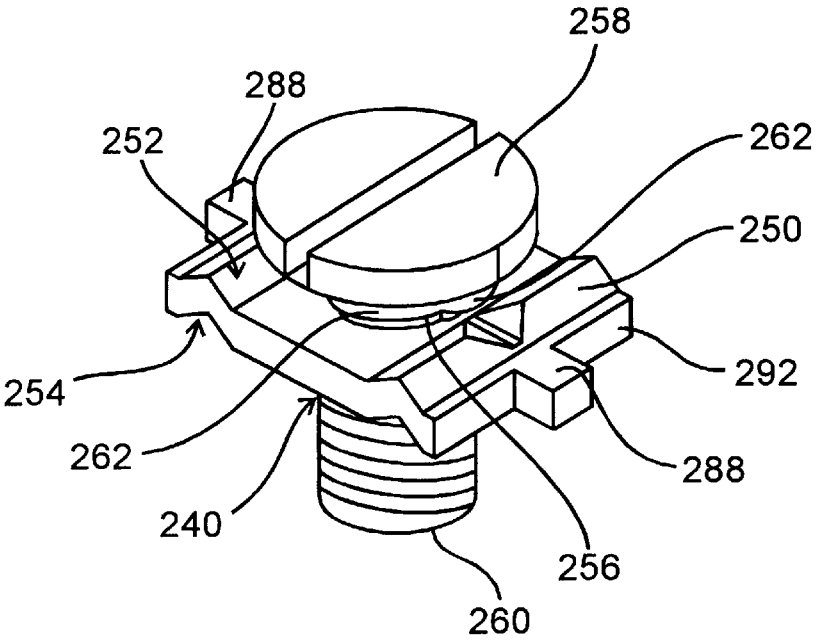
FIG. 9 is an isolated perspective view of the inventive clamp plate and fastener illustrated in FIGS. 7 and 8.
Figure 7:
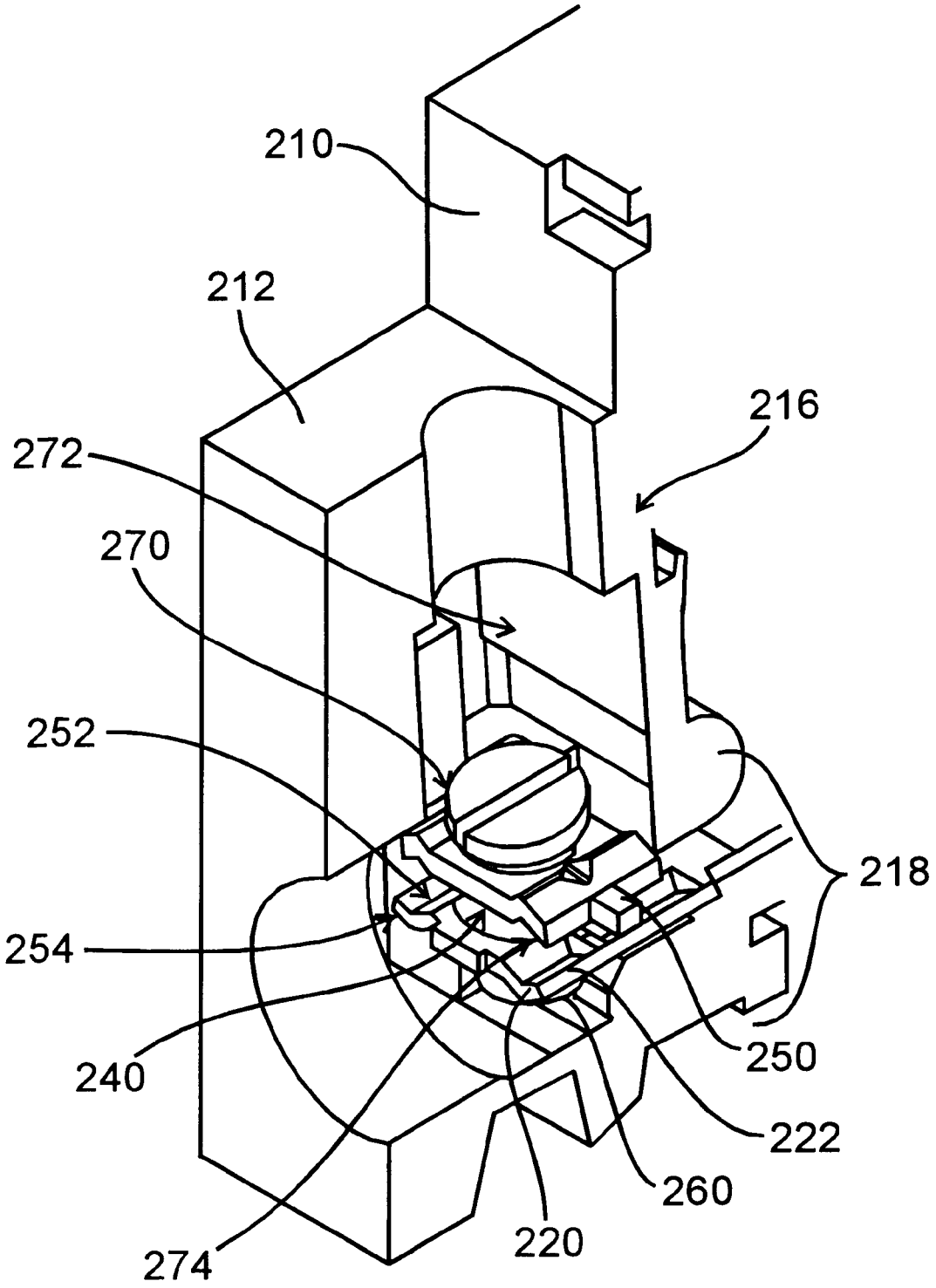
FIG. 7 is a partial perspective view of another preferred embodiment of an inventive terminal assembly within a circuit breaker housing with the clamp plate and a clamp body in a closed position.
Figure 8:
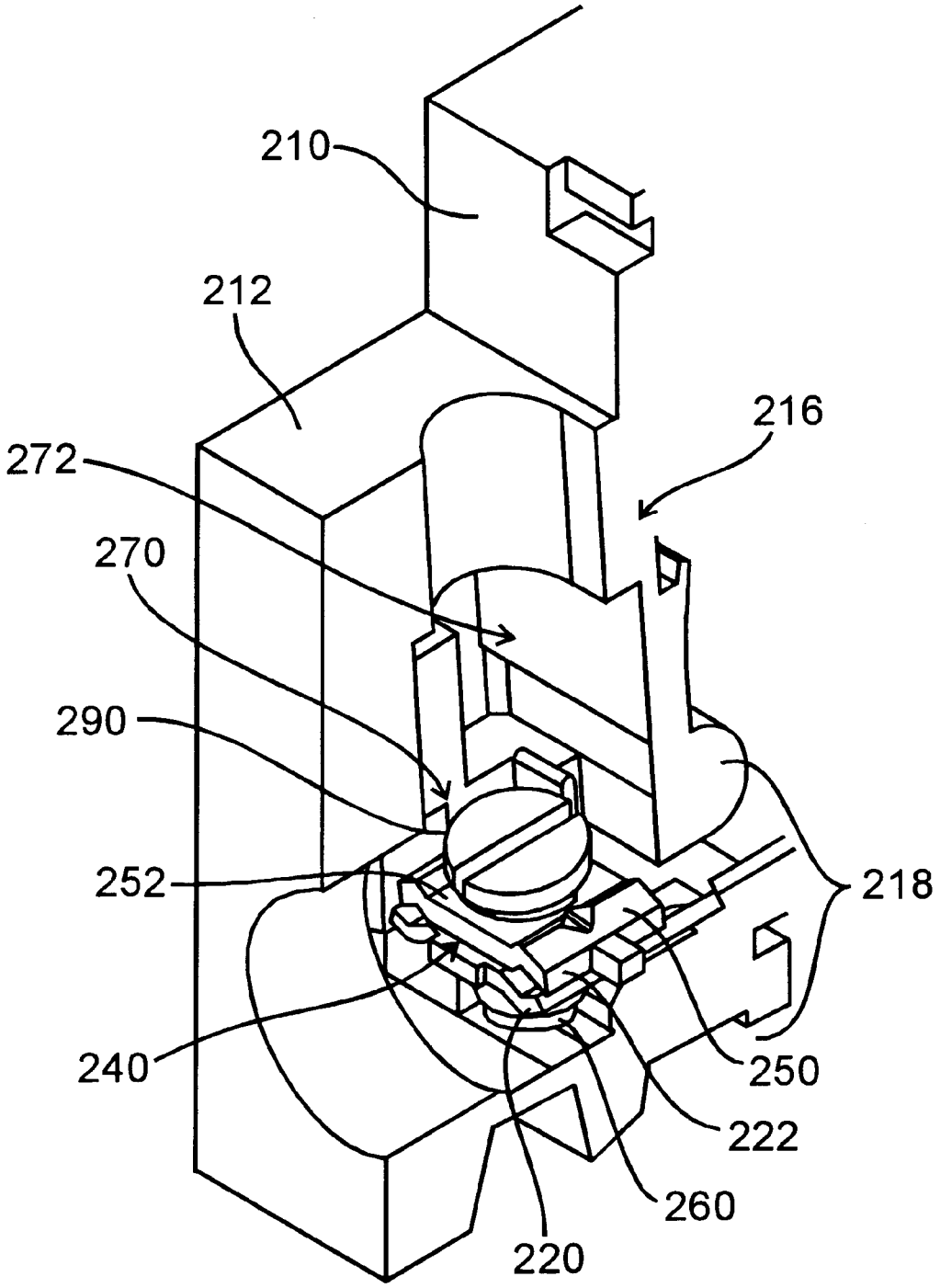
FIG. 8 is a partial perspective view of the inventive terminal assembly of FIG. 7 within a circuit breaker housing with the clamp plate and a clamp body in a closed position.

Another preferred embodiment of a terminal assembly 218 of the present invention is illustrated in FIGS. 7–9. The terminal assembly 218 includes a stop surface 270 which is defined by a housing 212 within an interior space 216 and, more particularly within the terminal area 272. The stop surface 270 is positioned within the pathway traveled by a clamp plate 222 between an open position and a closed position respectively illustrated in FIGS. 7 and 8. The open position provides a space 276 between the clamp body 220 and the clamp plate 222 for insertion of a wire or other electrical connector therebetween. Preferably, the clamp body 220 is in a fixed position relative to the interior of the housing 212 by its connection to other components of the operating system (not shown) of a circuit breaker 210. The clamp plate 222 moves into the closed position by travelling toward the clamp body 220. As a fastener 224 is rotated in a clockwise direction, the engagement of the screw threads 260 of the fastener and the threads 240 of the clamp body draws an annular ring 262, and thus the clamp plate 222, to the clamp body 220. As a result, the wire or electrical connector is mechanically and electrically clamped therebetween.

As the fastener 224 is rotated in a counter-clockwise direction, the clamp plate 222 moves away from the clamp body 220 to return to the open position. Eventually, the travel of the clamp plate 222 away from the clamp body 220 is terminated by the stop surface 270. A pair of opposing sides of the clamp plate 222 each includes a tab 288 which extends the top surface 252 of the clamp plate 222 beyond its periphery. The top surface 252 in the area of the tabs 288 eventually abuts and is stopped by the stop surface 270. Since the annular ring 262 connects the clamp plate 222 to the fastener 224, the fastener is stopped at this point along the pathway of travel and is retained in this position.

The stop surface 270 is preferably located along the travel pathway of the clamp plate a distance sufficient to allow enough space 274 between the clamp plate and clamp body for insertion of the wire and to prevent the bottom most screw threads 260 of the fastener from disengaging from the clamp body 220.

The housing 212 of the circuit breaker 210 is preferably configured to directly define the stop surface 270. The present invention provides a pair of grooves 290 as another non-limiting example of the means for limiting the travel and retaining the clamp plate 222 and fastener 224 with the remainder of the terminal assembly 218. The grooves 290 are positioned in an opposing relationship to one another. One of the grooves 290 is configured into the housing 212 facing the interior space 216. The other groove 290 is configured into the cover (not shown in FIG. 7 or 8) and likewise faces the interior space 216 when assembled with the remainder of the housing 212. The grooves 290 are sized to receive the tabs 288 extending outwardly from the periphery of the clamp plate 222. The tabs 288 reversibly slide along the longitudinal length of the grooves 290 between the closed and open positions respectively illustrated in FIGS. 7 and 8.

One end of each of the grooves 290 is defined by the stop surface 270. From the closed position, the tabs 288 of the clamp plate slide along the grooves 290 until their travel is stopped by abutting, or otherwise contacting, the stop surface 270 with the clamp plate 222 and clamp body 220 in the open position with sufficient space 274 therebetween for wire insertion. In contrast to the previously described preferred embodiment, the tabs 288 of the clamp plate rather than the stop surface 270 extends outwardly for their eventual cooperation to stop and retain the clamp plate 122/222 and fastener 124/224 with the remainder of the terminal assembly 118/218 without otherwise interfering with the travel of the clamp plate 122/222 between the open and closed positions.

FIG. 9 specifically illustrates a preferred embodiment of the clamp plate 222 includes a plate body 250 which is partially defined by a top surface 252, a bottom surface 254 and a periphery 292. The plate body 250 includes a plate aperture 256 for accommodating the fastener 224 through the body. Tabs 288 extend outwardly from the periphery 292 on opposite sides of the plate body 250. The tabs 288 are in the same plane as the plate body 250 and continue the top surface 252 beyond the periphery 292. The tabs 288 have a shape and size to mate with a corresponding configuration on opposing sides of the interior space 216 of the housing 212.

The fastener 224 includes a head 258 for abutting the top surface 252 of the clamp plate. Torque can also be applied to the head 258 with a tool or by the hand of an operator. The fastener includes screw threads 260 opposite the head 258.

The plate aperture 256 has a diameter smaller than the head 258 of the fastener, the annular ring 262, and the screw threads 260. The annular ring 262 retains the clamp plate 222 near the head 258 of the fastener while allowing the fastener 224 to rotate freely within the annular ring 262.

As described above, the present invention provides a method of retaining the individual components of a terminal assembly for connecting an electrical connector to an electrical distribution device. Preferably, the clamp body is affixing to the interior surface of the housing. The fastener is rotatably connected to the clamp plate. Prior to disengaging the fastener from the clamp body, the travel of the clamp plate is stopped against a portion of the interior surface of the housing as the fastener is rotated to separate the clamp plate from the clamp body so that the fastener is retained in connection with the clamp body and clamp plate even with the clamp plate and clamp body separated from each other to accommodate the insertion of the electrical connector therebetween.

The inventive terminal is particularly useful in providing an electrical and mechanical connection to the QO line of circuit breakers manufactured by The Square D Company. Although the inventive terminal has been described with regard to a circuit breaker, the present invention is not so limited. The inventive terminal can be used with prior art electrical devices like relay switches and the like to provide an improved electrical and mechanical contact while retaining the assembling together during wire installation. Without needing to upset several threads on the fastener to retain it in the terminal assembly, the extra available threads allow torque to be applied to the fastener in an amount significantly greater than possible with electrical terminals of the prior art. The ability of the inventive terminal assembly to provide mechanical and electrical connection to an electrical connector such as a wire, bar or the like without striping the threads in the "hold area" promotes wide application of the present invention.

While particular embodiments and applications of the present applications of the present invention have been illustrated and described, it is to be understood that the invention is not limited to the precise construction disclosed herein and that various modifications, changes, and variations will be apparent to those skilled in the art may be made in the arrangement, operation, and details of construction of the invention disclosed herein without departing from the spirit and scope of the invention as defined in the appended claims.

What is claimed is:

1. A terminal assembly for connecting an electrical connector to an electrical distribution device, the device having a housing with an interior surface defining an interior space, the terminal assembly comprising:

a clamp body having a first surface and a second surface, a portion of the first surface extending downward to define an interior wall of a cylinder, the interior wall extending perpendicularly to the first surface, a substantial portion of the interior wall of the cylinder having threads;

a fastener having a head at one end of an elongated body and screw threads near the opposite end, the screw threads being adapted to engage the threads on the interior wall of the cylinder of the clamp body;

a clamp plate having a plate body which is partially defined by a top surface and a bottom surface, the plate body having a plate aperture for accommodating the fastener through the plate body, the bottom surface is shaped to abut an electrical connector and releasably engage the electrical connector between the bottom surface and the first surface of the clamp body, the plate aperture forms an annular ring for affixing the clamp plate and fastener together while allowing the elongated body of the fastener to rotate within the aperture, the top surface of the plate body is shaped to abut the head of the screw in the proximity of the plate aperture; and means for retaining the fastener in connection with the clamp body and clamp plate even with the clamp plate and clamp body separated from each other to accommodate the insertion of the electrical connector therebetween and for preventing the fastener from disengaging from the clamp body and clamp plate, the retaining means being connected to and providing mechanical cooperation between the clamp plate and the interior surface of the housing, the retaining means having at least one projection integrally formed with the plate body, the plate body further defined by a periphery, the projection extending outwardly from the periphery of the plate body, the projection adapted to engage a stop surface positioned along the longitudinal travel path of the plate body on the interior surface of the housing when the clamp plate is sufficiently separated from the clamp body for insertion of an electrical connector therebetween.

2. The terminal assembly of claim 1 wherein the at least one projection is a pair of tabs, each tab extending outwardly from the periphery on opposite sides of the plate body, the tabs adapted to engage the stop surface when the clamp plate is sufficiently separated from the clamp body for insertion of an electrical connector therebetween.

3. The terminal assembly of claim 1 wherein the retaining means includes a housing adapter, the housing adapter includes:

a base having a surface;

a stop surface being connected to the base, the stop surface extending perpendicularly outwardly from the surface of the base, the stop surface configured for engaging a portion of the clamp plate to stop movement of the clamp plate;

means for fixedly connecting the base to the interior surface of the housing and positioning the stop surface in the pathway of the clamp plate being drawn to the clamp body to retain the fastener, clamp plate and clamp body together, the connecting means being integrally formed with the base.

4. The terminal assembly of claim 3 wherein the connecting means includes upstanding walls integrally formed with the base, the upstanding walls having a top surface and defining a channel therebetween, the channel adapted to receive a portion of the interior surface of the housing therein, the top surface of the upstanding walls adapted to abut another portion of the interior surface of the housing, the stop surface extending from the base in a direction opposite that of the top surface of the upstanding walls.

5. The terminal assembly of claim 1 wherein the electrical distribution device is a circuit breaker.

6. The terminal assembly of claim 1 wherein the clamp body further includes an elongated end adapted to make an electrical connection with the electrical distribution.

7. An electrical distribution device having terminal assembly for connecting an electrical connector to the device, the terminal assembly having:

a clamp body having a first surface and a second surface, the clamp body having a first surface and a second surface, a portion of the first surface extending downward to define an interior wall of a cylinder, the interior wall extending perpendicularly to the first surface, a substantial portion of the interior wall of the cylinder having threads;

a fastener having a head at one end of an elongated body and screw threads near the opposite end, the screw threads being adapted to engage the threads on the interior wall of the cylinder of the clamp body;

a clamp plate for connecting to the electrical connector, the clamp plate having a plate body which is partially defined by a top surface and a bottom surface, the plate body having a plate aperture for accommodating the fastener through the plate body, the bottom surface is shaped to abut an electrical connector and releasably engage the electrical connector between the bottom surface and the first surface of the clamp body, the plate aperture forms an annular ring for affixing the clamp plate and fastener together while allowing the elongated body of the fastener to rotate within the aperture, the top surface of the plate body is shaped to abut the head of the screw in the proximity of the plate aperture; the device comprising:

a housing with an interior surface defining an interior space; and a stop surface being defined by a portion of the interior surface extending perpendicularly outwardly from the remainder of the interior surface, the stop surface being positioned along the longitudinal travel path of the fastener and clamp plate, the stop surface being configured to engage a portion of the clamp plate to stop movement of the clamp plate so that the fastener is retained in connection with the clamp body and clamp plate even with the clamp plate and clamp body separated from each other to accommodate the insertion of the electrical connector therebetween and the fastener is prevented from disengaging from the clamp body and clamp plate.

8. The device of claim 7 wherein the interior surface of the housing includes a pair of grooves positioned on opposite sides of the interior surface, each groove having an elongated opening facing the other groove, one of each elongated opening defining the stop surface.

9. The device of claim 7 wherein the clamp plate includes a pair of tabs, each tab extending outwardly from the periphery on opposite sides of the plate body, each of the tabs adapted to engage within one of the grooves, the tabs abutting the stop surface when the clamp plate is sufficiently separated from the clamp body for insertion of an electrical connector therebetween and the fastener is still connected to the clamp plate and clamp body.

10. The device of claim 9 wherein the interior surface includes an adapter having:

a base having a surface;

the stop surface being connected to the base, the stop surface extending perpendicularly outwardly from the surface of the base, the stop surface configured for engaging a portion of the clamp plate to stop movement of the clamp plate; and means for fixedly connecting the base to the interior surface of the housing and positioning the stop surface in the pathway of the clamp plate being drawn to the clamp body to retain the fastener, clamp plate and clamp body together, the connecting means being integrally formed with the base.

11. The device of claim 10 wherein the connecting means includes upstanding walls integrally formed with the base, the upstanding walls having a top surface and defining a channel therebetween, the channel adapted to receive a portion of the interior surface of the housing therein, the top surface of the upstanding walls adapted to abut another portion of the interior surface of the housing, the stop surface extending from the base in a direction opposite that of the top surface of the upstanding walls.

12. A housing adapter for a terminal assembly, the terminal assembly connecting an electrical connector to an electrical distribution device, the device having a housing with an interior surface defining an interior space, the terminal assembly having a fastener for drawing a clamp plate and a clamp body together for connection to an electrical connector therebetween, the clamp plate having a plate body which is partially defined by a top surface and a bottom surface, the plate body having a plate aperture for accommodating the fastener through the plate body, the bottom surface is shaped to abut an electrical connector and releasably engage the electrical connector between the bottom surface and the first surface of the clamp body, the plate aperture forms an annular ring for affixing the clamp plate and fastener together while allowing the elongated body of the fastener to rotate within the aperture, the top surface of the plate body is shaped to abut the head of the screw in the proximity of the plate aperture, the adapter comprising:

a base having a surface;

a stop surface being connected to the base, the stop surface extending perpendicularly outwardly from the surface of the base, the stop surface being configured for engaging a portion of the clamp plate to stop movement of the clamp plate so that the fastener is retained in connection with the clamp body and clamp plate even with the clamp plate and clamp body separated from each other to accommodate the insertion of the electrical connector therebetween and the fastener is prevented from disengaging from the clamp body and clamp plate, the stop surface being positioned along the longitudinal travel path of the fastener and clamp plate;

means for fixedly connecting the base to the interior surface of the housing and positioning the stop surface in the longitudinal pathway of the clamp plate being drawn to the clamp body to retain the fastener, clamp plate and clamp body together, the connecting means being integrally formed with the base.

13. The housing adapter of claim 12 wherein the connecting means includes upstanding walls integrally formed with the base, the upstanding walls having a top surface and defining a channel therebetween, the channel adapted to receive a portion of the interior surface of the housing therein, the top surface of the upstanding walls adapted to abut another portion of the interior surface of the housing, the stop surface extending from the base in a direction opposite that of the top surface of the upstanding walls.

14. A clamp plate for a terminal assembly, the terminal assembly connecting an electrical connector to an electrical distribution device, the device having a housing with an interior surface defining an interior space, the terminal assembly having a fastener for drawing a clamp body and the clamp plate together for connection to an electrical connector therebetween, the clamp plate comprising:

a plate body which is partially defined by a top surface, a bottom surface and a periphery, the plate body having a plate aperture for accommodating the fastener through the plate body, the bottom surface is shaped to abut the electrical connector and releasably engage the electrical connector between the bottom surface and the clamp body, the plate aperture forms an annular ring for connecting the clamp plate and fastener together while allowing the elongated body of the fastener to rotate within the aperture, the top surface is shaped to abut the head of the screw in the proximity of the plate aperture;

at least one projection integrally formed with the plate body, the projection extending outwardly from the periphery of the plate body, the projection adapted to engage a stop surface when the clamp plate is sufficiently separated from the clamp body for insertion of an electrical connector therebetween, the stop surface being positioned along the longitudinal travel path of the fastener and clamp plate, the stop surface being configured to engage a portion of the clamp plate to stop movement of the clamp plate, to retain the fastener in connection with the clamp body and clamp plate even with the clamp plate and clamp body separated from each other to accommodate the insertion of the electrical connector therebetween and to prevent the fastener from disengaging from the clamp body and clamp plate.

15. The clamp plate of claim 14 wherein the at least one projection is a pair of tabs, each tab extending outwardly from the periphery on opposite sides of the plate body, the tabs adapted to engage the stop surface when the clamp plate is sufficiently separated from the clamp body for insertion of an electrical connector therebetween.

16. A method of retaining the individual components of a terminal assembly for connecting an electrical connector to an electrical distribution device, the device having a housing with an interior surface defining an interior space, the terminal assembly having a fastener for drawing a clamp plate and a clamp body together for connection to an electrical connector therebetween, the steps of the method comprising:

affixing the clamp body to the interior surface of the housing;

rotatably affixing the fastener to the clamp plate; and prior to disengaging the fastener from the clamp body, stopping the travel of the clamp plate against a portion of the interior surface of the housing as the fastener is rotated to separate the clamp plate from the clamp body so that the fastener is retained in connection with the clamp body and clamp plate even with the clamp plate and clamp body separated from each other to accommodate the insertion of the electrical connector therebetween and to prevent the fastener from disengaging from the clamp body and clamp plate.

* * * * *